US011470942B2

(12) United States Patent
Song

(10) Patent No.: US 11,470,942 B2
(45) Date of Patent: Oct. 18, 2022

(54) COSMETIC CONTAINER HAVING HANDLING PORTION

(71) Applicant: WORLD SPONGE MANUFACTURING CO., LTD., Incheon (KR)

(72) Inventor: Ho Suk Song, Uiwang-si (KR)

(73) Assignee: WORLD SPONGE MANUFACTURING CO., LTD., Incheon (KR)

( * ) Notice: Subject to any disclaimer, the term of this patent is extended or adjusted under 35 U.S.C. 154(b) by 243 days.

(21) Appl. No.: 16/759,837

(22) PCT Filed: Feb. 2, 2018

(86) PCT No.: PCT/KR2018/001444
§ 371 (c)(1),
(2) Date: Apr. 28, 2020

(87) PCT Pub. No.: WO2019/107670
PCT Pub. Date: Jun. 6, 2019

(65) Prior Publication Data

US 2021/0368961 A1 Dec. 2, 2021

(30) Foreign Application Priority Data

Nov. 28, 2017 (KR) ..... 10-2017-0160307
Jan. 22, 2018 (KR) ..... 10-2018-0007678

(51) Int. Cl.
*A45D 40/26* (2006.01)
*A45D 34/04* (2006.01)
(Continued)

(52) U.S. Cl.
CPC ..... *A45D 33/36* (2013.01); *A45D 33/003* (2013.01); *A45D 34/043* (2013.01);
(Continued)

(58) Field of Classification Search
CPC .... A45D 34/04; A45D 34/042; A45D 34/043; A45D 34/045; A45D 34/046;
(Continued)

(56) References Cited

U.S. PATENT DOCUMENTS 643,803 A * 2/1900 Schott
1,562,867 A * 11/1925 Bush ..... B27G 11/02 401/127
(Continued)

FOREIGN PATENT DOCUMENTS

JP S61-058416 10/1987
JP S61-119883 2/1988
(Continued)

*Primary Examiner* — David J Walczak
(74) *Attorney, Agent, or Firm* — Lex IP Meister, PLLC

(57) ABSTRACT

A cosmetic container having a handling portion. The cosmetic container including: a body part (100) provided in an open hollow shape, and configured to store a cosmetic product; and a handling portion (300) detachably coupled to the upper side of the body part (100); wherein the handling portion (300) includes: a direction adjusting portion (320); a handle portion (310) provided to vertically pass through one side of the direction adjusting portion (320); a touch member seating portion (330) formed at the lower end of the handle portion (310); and a touch member (340) seated on the touch member seating portion (330).

12 Claims, 8 Drawing Sheets

(51) Int. Cl.
*A45D 33/36* (2006.01)
*A45D 33/00* (2006.01)

(52) U.S. Cl.
CPC ..... *A45D 34/045* (2013.01); *A45D 40/264* (2013.01); *A45D 40/265* (2013.01); *A45D 2200/053* (2013.01); *A45D 2200/1018* (2013.01)

(58) Field of Classification Search
CPC .... A45D 40/26; A45D 40/262; A45D 40/264; A45D 40/265; A45D 40/267; A45D 33/36; A45D 33/003; A45D 33/34; A45D 2200/053; A45D 2200/1018
USPC ..... 401/121, 122, 126–130, 16, 44–47
See application file for complete search history.

(56) References Cited

U.S. PATENT DOCUMENTS 1,715,144 A * 5/1929 Paulson ..... B27G 11/02 401/121
1,954,068 A * 4/1934 Carpenter ..... B43M 11/06 401/127
2,783,489 A * 3/1957 Bogoslowsky ..... A45D 40/265 206/229
6,120,202 A * 9/2000 Donsky ..... A45D 40/24 401/35
7,329,064 B2 * 2/2008 Byun ..... A46B 11/0041 401/278
2013/0101334 A1 4/2013 Simard et al.

FOREIGN PATENT DOCUMENTS

| | | |
|---|---|---|
| JP | 64-043816 | 3/1989 |
| JP | S62-137555 | 3/1989 |
| JP | H 09-182616 | 7/1997 |
| JP | 2008-206540 | 9/2008 |
| JP | 2012-213463 | 11/2012 |
| KR | 20-0438485 | 2/2008 |
| KR | 10-2011-0045144 | 5/2011 |
| KR | 20-0463032 | 10/2012 |
| KR | 20-2016-0001992 | 6/2016 |
| KR | 10-2017-0070891 | 6/2017 |
| WO | 2019/107670 | 6/2019 |

* cited by examiner

COSMETIC CONTAINER HAVING HANDLING PORTION

TECHNICAL FIELD

The present invention relates to a cosmetic container. More specifically, the present invention relates to a cosmetic container having a handling portion in which a touch member is coupled to an end of a handle portion that is adjustable up, down, right, and left.

BACKGROUND ART

In general, a portable makeup tool called a compact is provided in the form in which a powder or solid cosmetic product is mainly stored inside a case and it is possible to conveniently put on makeup using a puff while carrying the makeup tool and consulting a mirror provided on the inner circumferential surface of a lid.

Such conventional compact containers have problems in that it is difficult to store cosmetic products having various physical properties and it is difficult to easily combine and touch cosmetic products having various colors. Furthermore, the conventional compact containers have a problem in that a user cannot put on fine makeup because a cosmetic product cracks or lumps during use.

DISCLOSURE

Technical Problem

A cosmetic container having a handling portion according to the present invention has the following objects:

A first object is to enable a handle portion to be handled up, down, right, and left.

A second object is to enable a touch member, mounted on a handle portion, to easily touch a cosmetic product stored inside a cosmetic container.

A third object is to enable various types of cosmetic products to be touched.

A fourth object is to enable a user-desired quantity of a cosmetic product to be applied to a touch member.

A fifth object is to enable a cosmetic product to remain in its original state for a long time.

The objects of the present invention are not limited to those mentioned above, and other objects that are not mentioned will be clearly understood by those skilled in the art from the following description.

Technical Solution

The present invention relates to a cosmetic container having a handling portion, the cosmetic container including: a body part provided in an open hollow shape, and configured to store a cosmetic product; and a handling portion detachably coupled to the upper side of the body part; wherein the handling portion includes: a direction adjusting portion; a handle portion provided to vertically pass through one side of the direction adjusting portion; a touch member seating portion formed at the lower end of the handle portion; and a touch member seated on the touch member seating portion.

In the present invention, it is preferable that the direction adjusting portion is made of a soft material so that the handle portion is adjustable up, down, right, and left.

In the present invention, it is preferable that the direction adjusting portion includes a plurality of corrugations that are formed in a vertical or lateral direction.

In the present invention, it is preferable that the height (H or h) of the ridges of the corrugations decreases from the inner side to the outer side when the corrugations are formed in the vertical direction, and the width (W) of the corrugations increases from the upper side to the lower side when the corrugations are formed in the lateral direction.

In the present invention, it is preferable that the thickness of the furrows of the corrugations is smaller than that of the ridges of the corrugations.

In the present invention, it is preferable that the direction adjusting portion is made of an elastic material so that the handle portion is adjustable up, down, right, and left.

In the present invention, it is preferable that a blocking member is provided on the inside of the direction adjusting portion made of the elastic material.

In the present invention, it is preferable that the handle portion includes a plurality of handle portion members provided to be coupled to each other so that the length of the handle portion is extendable.

In the present invention, it is preferable that the touch member is a sponge or a puff.

In the present invention, it is preferable that a connection portion having a corresponding shape is coupled to the upper end of the body part, and the connection portion is detachably coupled to the handling portion.

In the present invention, it is preferable that a plate configured to store a cosmetic product is additionally provided in the lower end of the body part.

In the present invention, it is preferable that the plate is partitioned such that heterogeneous cosmetic products can be stored therein.

In the present invention, it is preferable that the heterogeneous cosmetic products are one or more of a solid cosmetic product, a powder cosmetic product, and a liquid cosmetic product.

In the present invention, it is preferable that a cover portion configured to cover the direction adjusting portion is coupled to the handle portion of the handling portion.

In the present invention, it is preferable that protrusions are further provided on one side of the inner surface of the body part.

In the present invention, it is preferable that an air check valve is provided in one side of the body part.

Advantageous Effects

The cosmetic container having a handling portion according to the present invention has the following effects:

First, the direction adjusting portion is made of a soft material in a corrugated shape, and thus there is achieved an effect in which the handle portion can be freely moved up, down, right, and left.

Second, accordingly, there is achieved an effect in which the touch member can be coated with a stored cosmetic product while easily touching the cosmetic product.

Third, the plate is partitioned, and thus there are achieved effects of storing various types of cosmetic products such as liquid, solid and powder cosmetic products, etc. and applying a cosmetic product to the touch member.

Fourth, there is achieved an effect of performing adjustment using the protrusions of the body part so that a user-desired quantity of a cosmetic product is applied to the touch member.

Fifth, there is achieved an effect of keeping the storage state of a cosmetic product desirable by reducing pressure inside the cosmetic container.

The effects of the present invention are not limited to those mentioned above, and other effects that are not mentioned will be clearly understood by those skilled in the art from the following description.

BEST MODE

The present invention relates to a cosmetic container having a handling portion, the cosmetic container including: a body part provided in an open hollow shape, and configured to store a cosmetic product; and a handling portion detachably coupled to the upper side of the body part; wherein the handling portion includes: a direction adjusting portion; a handle portion provided to vertically pass through one side of the direction adjusting portion; a touch member seating portion formed at the lower end of the handle portion; and a touch member seated on the touch member seating portion.

MODE FOR INVENTION

Embodiments of the present invention will be described with reference to the accompanying drawings below so that those having ordinary skill in the art to which the present invention pertains can easily practice the present invention. As those having ordinary skill in the art to which the present invention pertains can readily understand, the embodiments described below may be modified in various forms without departing from the concept and scope of the present invention. The same or similar parts are denoted by the same reference symbols throughout the drawings as much as possible.

The technical terms used herein are used merely to illustrate specific embodiments and are not intended to limit the invention. The singular forms used herein include plural forms unless the phrases clearly indicate the opposite.

The term "include" used herein is intended to specify specific features, regions, integers, steps, operations, elements and/or components, but is not intended to exclude the presence or addition of one or more other features, regions, integers, steps, operations, elements, components and/or groups thereof.

All the terms including the technical terms and the scientific terms used herein have the same meanings as generally understood by those having ordinary skill in the art to which the present invention pertains. The terms defined in dictionaries are additionally interpreted as having meanings consistent with the related technical literature and the presently disclosed content, and are not interpreted as having ideal or very formal meanings unless defined.

The present invention will be described based on the drawings below.

Figure 1:
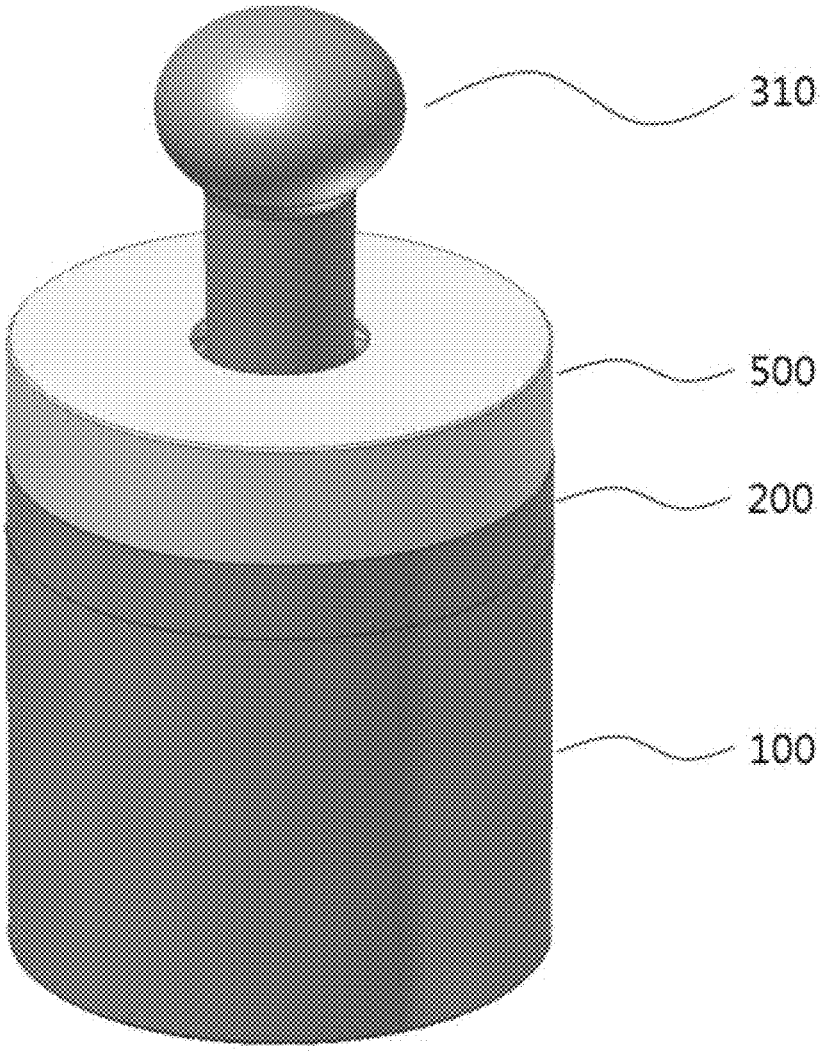
FIG. 1 is a perspective view of a cosmetic container according to the present invention.
Figure 2:
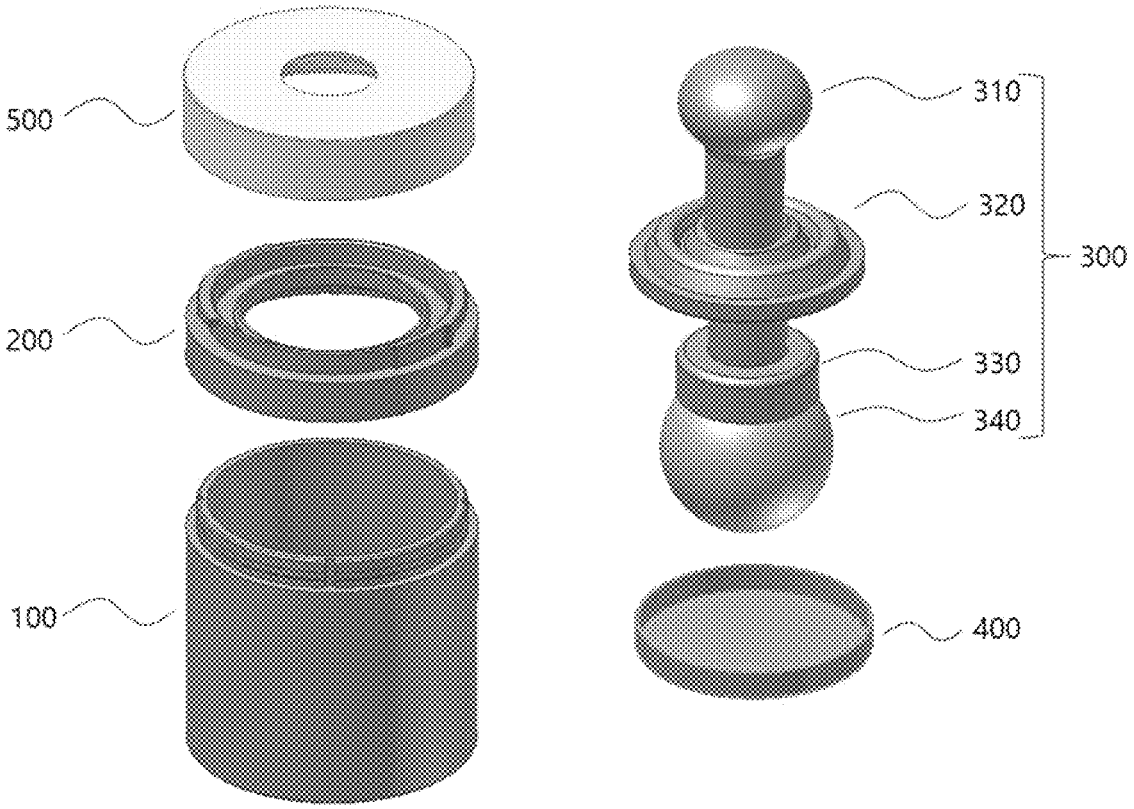
FIGS. 2 and 3 are exploded views of the assembled cosmetic container shown in FIG. 1.
Figure 3:
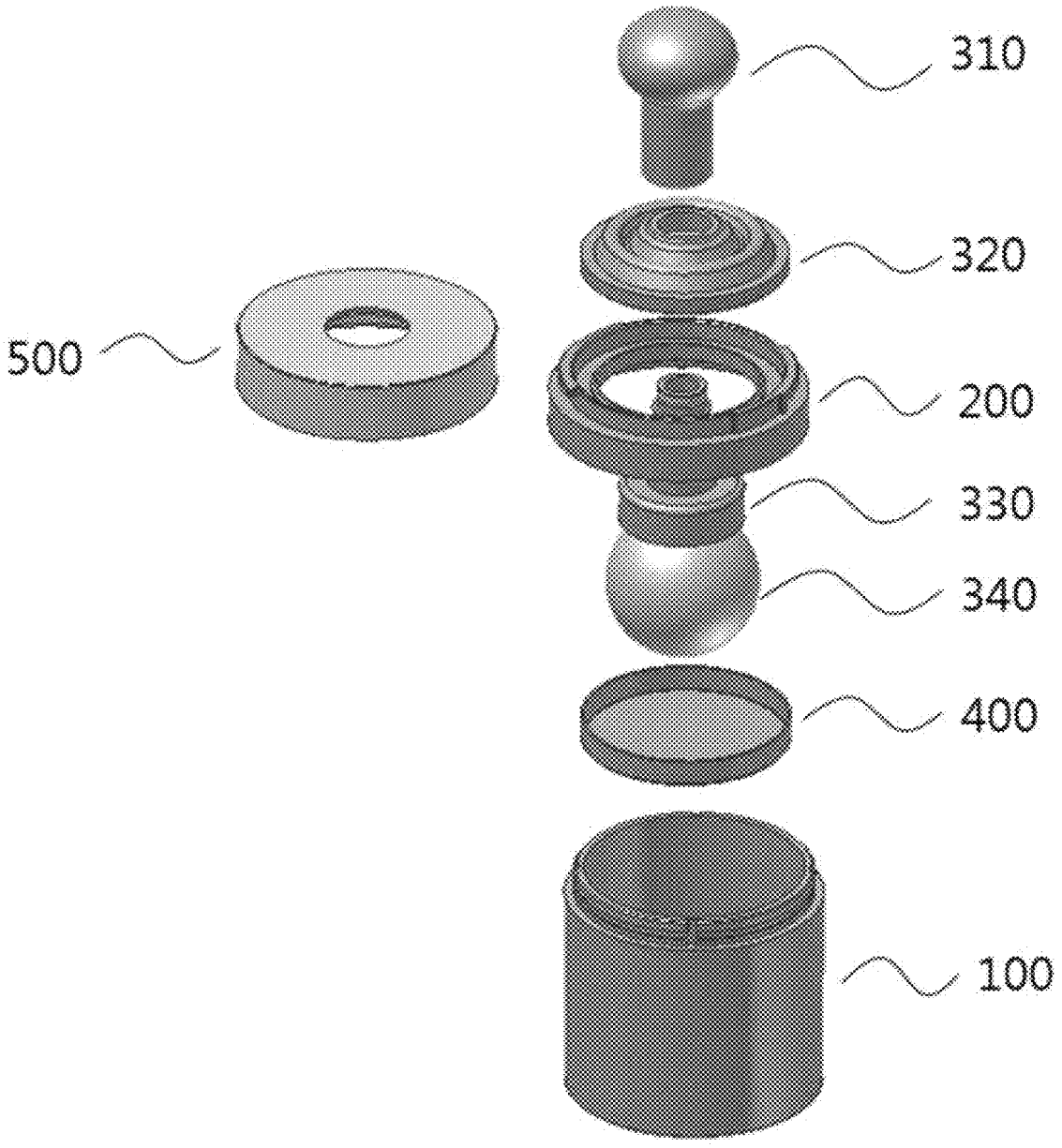

FIG. 1 is a perspective view of a cosmetic container according to the present invention. FIGS. 2 and 3 are exploded views of the assembled cosmetic container shown in FIG. 1.

The present invention relates to a cosmetic container having a handling portion. The cosmetic container according to the present invention includes: a body part 100 provided in an open hollow shape, and configured to store a cosmetic product; and a handling portion 300 detachably coupled to the upper side of the body part 100; and the handling portion 300 includes: a direction adjusting portion 320; a handle portion 310 provided to vertically pass through one side of the direction adjusting portion 320; a touch member seating portion 330 formed at the lower end of the handle portion 310; and a touch member 340 seated on the touch member seating portion 330.

The body part 100 according to the present invention has an open hollow shape. As shown in FIGS. 2 and 3, the top of the body part is generally open. Alternatively, the body part 100 may have a shape in which a bottom is separated from the body part and is open.

The handling portion 300 according to the present invention is detachably coupled to the upper side of the body part 100, and includes the handle portion 310, the direction adjusting portion 320, the touch member seating portion 330, and the touch member 340.

The handle portion 310 according to the present invention is preferably provided to vertically pass through one side of the direction adjusting portion 320, and generally passes through the center of the direction adjusting portion 320.

In the handle portion 310 according to the present invention, the upper end of the handle portion 310 may be provided in a spherical shape, as shown in FIG. 1, so that a user can easily grip the handle portion 310. Furthermore, in order to adjust the length of the handle portion 310, a plurality of handle portion members are provided to be coupled to each other and increase the length of the handle portion 310.

It is preferable that the direction adjusting portion 320 according to the present invention is made of a soft material, so that the handle portion is adjustable up, down, right, and left. This embodiment corresponds to operating the handle portion up, down, right, and left using the characteristics of the soft material.

Figure 4:
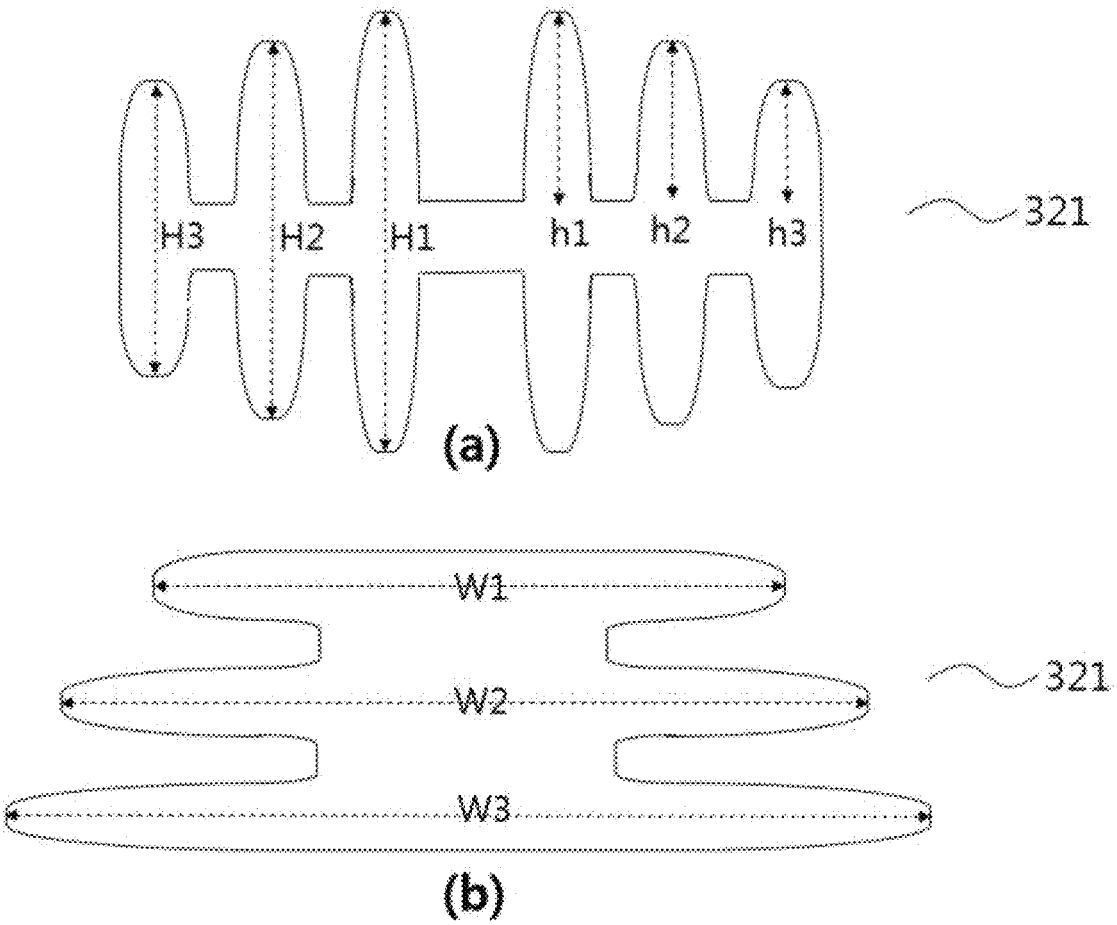
FIGS. 4(*a*) and 4(*b*) show the vertical direction corrugations of a direction adjusting portion and the lateral corrugations of a direction adjusting portion, respectively.

In the present invention, the direction adjusting portion 320 is preferably provided as a plurality of corrugations 321 formed in a vertical direction (see FIG. 4(*a*)) or in a lateral direction (see FIG. 4(*b*)). The plurality of corrugations may easily implement up, down, right, and left movement. The corrugations 321 function as an elastic element like a kind of spring. The corrugations 321 move up, down, right, or left and then return to their original position.

When the corrugations 321 according to the present invention are formed in the vertical direction, it is preferable that the height H or h of the ridges of the corrugations decreases from the inner side to the outer side (see FIG. 4(*a*)). There may be also implemented an embodiment in which the length between the ridges of corrugations is set to the height H, and there may be also implemented an embodiment in which the length from a predetermined reference height to the tops of the ridges of corrugations is set to the height h.

When the corrugations 321 according to the present invention are formed in the lateral direction, it is preferable that the width W of the corrugations increases from the upper side to the lower side (see FIG. 4(*b*)).

Figure 5:
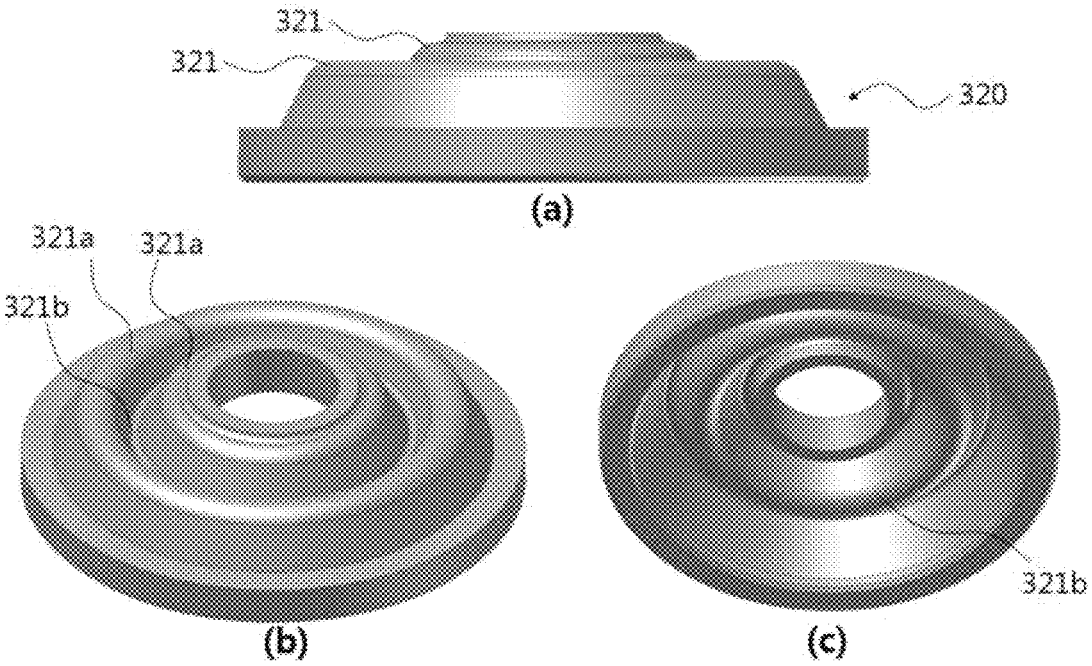
FIGS. 5(*a*) to 5(*c*) are views showing an embodiment of a direction adjusting portion having vertical corrugations.

FIGS. 5(*a*) to 5(*c*) are views showing an embodiment of the direction adjusting portion 320 having vertical corrugations.

In the present invention, it is preferable that the thickness of the furrows 321*b* of the corrugations 321 is smaller than that of the ridges 321*a* thereof. When the thickness of the furrows 321*b* of the corrugations 321 is smaller than that of the ridges 321*a* thereof, up, down, right, and left operations using corrugations are more easily performed.

The direction adjusting portion according to the present invention may be made of an elastic material. The direction adjusting portion made of an elastic material will enable a handle portion to be adjusted up, down, right, and left.

As an embodiment, the direction adjusting portion may be provided as an elastic coil having a wide bottom, narrow top shape or a tapered shape, like a spring.

It is preferable that a blocking member (not shown) is provided on the inside of the direction adjusting portion made of an elastic material according to the present invention. The blocking member may be made of plastic, vinyl or the like capable of preventing a cosmetic product from leaking, and may be provided so as not to interfere with the up, down, right, and left adjustment of the direction adjusting portion.

The touch member 340 according to the present invention is preferably a sponge or puff.

In the present invention, there may be implemented an embodiment in which a connection portion 200 having a corresponding shape is coupled to the upper end of the body part 100 and the connection portion 200 is detachably coupled to the handling portion 300.

The handling portion 300 is used to separate the touch member 340, mounted at the lower end of the handling portion, from the body part 100 after being coated with the cosmetic product stored in the body part 100 and then touch the touch member 340 to the skin of a user. Accordingly, the handling portion 300 needs to be detachable from the body part 100.

There may be also implemented an embodiment in which the handling portion 300 is coupled to the upper end of the body part 100. In this embodiment, coupling force may be weak because the handling portion 300 is coupled to the body part 100 in a detachable form. In this case, it is preferable to provide the separate connection portion 200, securely couple the body part 100 and the connection portion 200 and then detachably connect the handling portion 300 to the connection portion 200.

In the present invention, it is preferable that a plate 400 in which a cosmetic product is stored is additionally provided at the bottom of the body part 100. In an embodiment in which the plate 400 is not provided, there may be implemented an embodiment in which a cosmetic product is stored in the lower portion of the body part 100. However, in the case where the plate 400 is provided, when only the plate 400 is replaced with a desired one as needed, there may be obtained a cosmetic container in which a cosmetic product having a different color or different physical properties is stored. An advantage arises in that it may be possible to continue to use the cosmetic container in such a manner as to replace the plate 400 even after using up the overall cosmetic product.

Meanwhile, in the lower portion of the body part 100 or the plate 400 in which the cosmetic product is stored, a portion with which the touch member 340 does not come into contact may occur at a corner of the bottom or the like. Since the cosmetic product stored in the above portion is likely to be unusable, it is more preferable that the cosmetic container is shaped by protruding the portion in a rounded (bent) form so that such a portion does not occur.

In the present invention, particularly preferable is an embodiment in which the plate 400 is partitioned and can store heterogeneous cosmetic products.

It is preferable that the heterogeneous cosmetic products stored in the plate are one or more of a solid cosmetic product, a powder cosmetic product, and a liquid cosmetic product. Although the solid and powder cosmetic products have physical properties that allow easy storage in the plate 400, the liquid cosmetic product may flow out of the plate 400. Accordingly, the liquid cosmetic product applied to the present invention is more preferably in a form in which a cushion or net is formed on a liquid surface so that the liquid cosmetic product does not flow out of the plate.

Furthermore, the heterogeneous cosmetic products may be classified according to their physical properties or color. For example, a user may attempt to combine desired colors by touching a compartment in which a cosmetic product having color B is stored with the touch member 340 after touching a compartment in which a cosmetic product having color A is stored with the touch member 340 or by touching a compartment in which a cosmetic product having color C is stored with the touch member 340 after touching the compartment in which the cosmetic product having color A is stored with the touch member 340.

Figure 6:
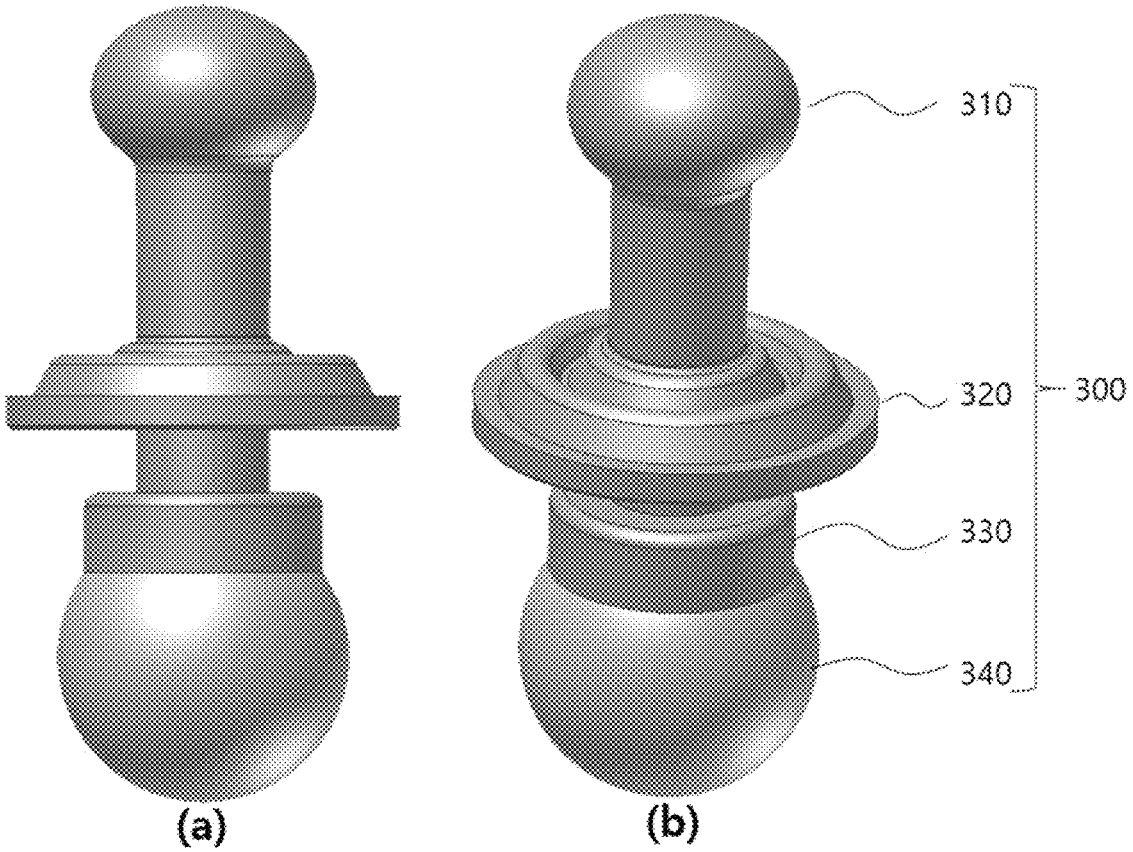
FIGS. 6(*a*) and 6(*b*) are views showing an embodiment in which a cover portion is not coupled to a handling portion according to the present invention.

In the present invention, it is preferable that a cover portion 500 configured to cover the direction adjusting portion 320 is coupled to the handle portion 310 of the handling portion 300. FIGS. 6(*a*) and 6(*b*) are views showing an embodiment in which a cover portion is not coupled to the handling portion according to the present invention, whereas FIGS. 7(*a*) and 7(*b*) are views showing an embodiment in which the cover portion 500 is coupled to the handling portion 300 according to the present invention.

Figure 7:
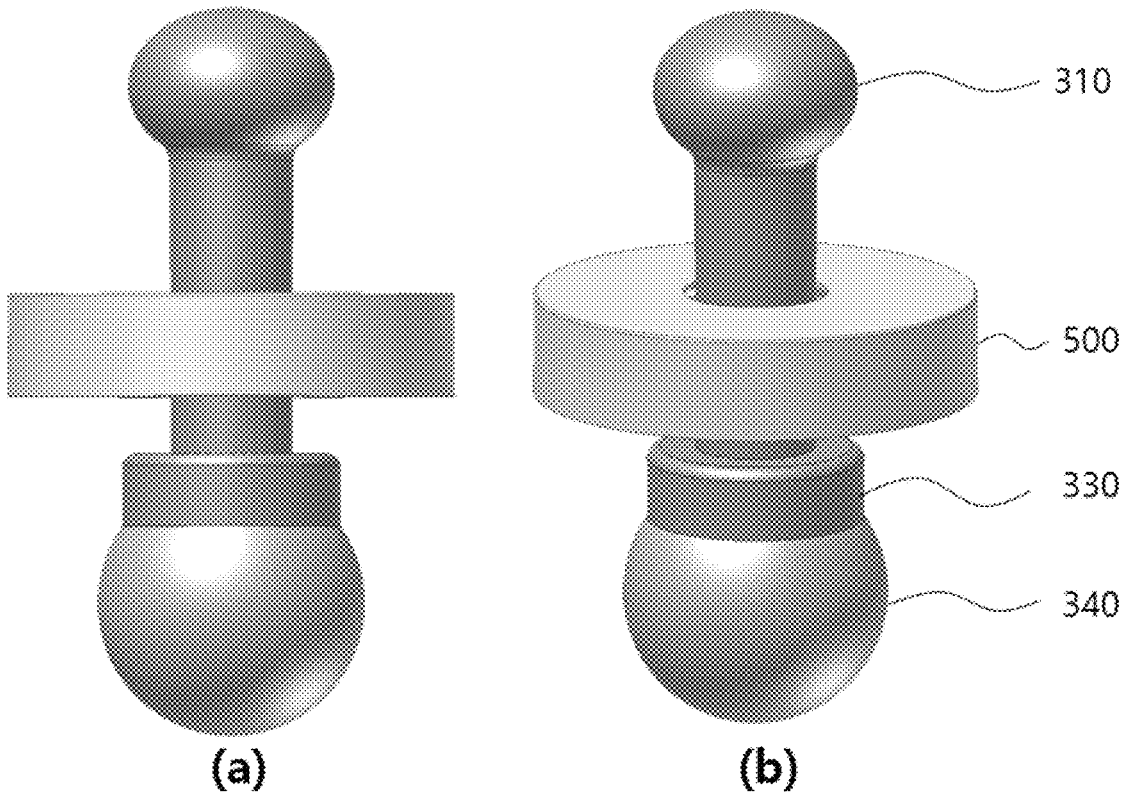
FIGS. 7(*a*) and 7(*b*) are views showing an embodiment in which a cover portion is coupled to a handling portion according to the present invention.

As shown in FIG. 7, the cover portion 500 is coupled with the handle portion 310 in an integrated manner, and is also taken out from the body part 100 when the handle portion 310 is taken out from the body part 100. The cover portion 500 is preferably formed at various transparency levels, such as a transparent level, a translucent level, and an opaque level.

Figure 8:
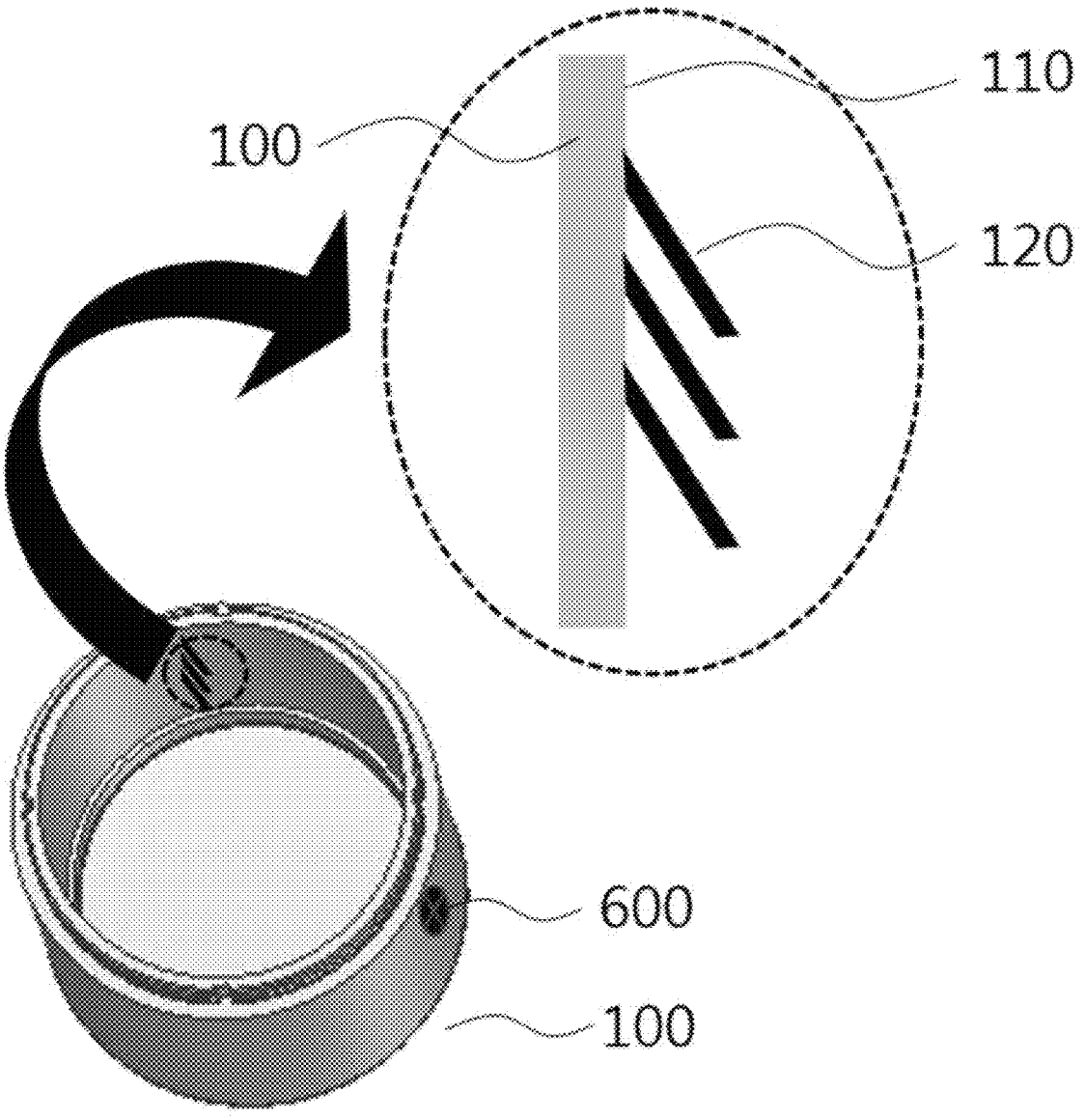
FIG. 8 is a view showing protrusions and an air check valve according to the present invention.

In the present invention, as shown in FIG. 8, it is preferable that protrusions 110 are further provided on one side of the inner surface of the body part 100. When the touch member 340 is coated with an excessively large quantity of a cosmetic product or with lumpy power rather than fine powder, or the like, a user may bring the touch member 340 to the protrusions 110 inside the body part 100, may adjust the quantity of a cosmetic product to a desired quantity in such a way as to touch the protrusions 110 with the touch member 340 or to rub the touch member 340 against the protrusions 110, and may then take out the touch member 340 from the body part 100.

In the present invention, it is preferable that an air check valve 600 is provided in one side of the body part 100. The air check valve 600 functions to reduce pressure inside the body part 110. After finishing makeup, a user couples the handling portion 300 to the body part 100 or connection portion 200. Thereafter, when the user pumps the handle portion 310 up and down while preventing the touch member 340 of the handling portion 300 from coming into contact with the stored cosmetic product, the pressure of the body part 100 is reduced as the air inside the body part 100 is discharged to the outside through the air check valve 600.

In the case of a solid or powder cosmetic product, when oil contained in the product is evaporated, a phenomenon in which the cosmetic product is cracked or broken may occur, which may cause a problem in that it is difficult to apply fine cosmetics to the touch member 340. In addition, even in the case of a liquid cosmetic product, when a liquid material contained in the product is evaporated, a problem may occur in that the quality of the liquid cosmetic product is lowered. In these cases, oil or the like contained in the cosmetic product may be prevented from being evaporated by reducing the pressure of the body part 100 in which the cosmetic product is stored, thereby overcoming the above-described problems and also maintaining the quality of the cosmetic product as much as possible.

The embodiments described in the present specification and the accompanying drawings are merely illustrative of some of the technical spirit included in the present invention. Therefore, the embodiments disclosed in the present specification are not intended to limit the technical spirit of the present invention, but are intended to describe the technical spirit of the present invention. Accordingly, it will be apparent that the scope of the technical spirit of the present invention is not limited by these embodiments. All modifications and specific embodiments that may be easily inferred within the scope of the technical spirit included in the specification and accompanying drawings of the present invention by those skilled in the art should be interpreted as being included in the scope of the present invention.

The invention claimed is:

1. A cosmetic container having a handling portion, the cosmetic container comprising:

a body part provided in an open hollow shape, and configured to store a cosmetic product; and a handling portion detachably coupled to an upper side of the body part;

wherein the handling portion comprises: a direction adjusting portion; a handle portion provided to vertically pass through one side of the direction adjusting portion; a touch member seating portion formed at a lower end of the handle portion; and a touch member seated on the touch member seating portion, wherein the direction adjusting portion is made of a soft material so that the handle portion is adjustable up, down, right, and left, wherein the direction adjusting portion includes a plurality of corrugations that are formed in a vertical or lateral direction, wherein:

when the corrugations are formed in the vertical direction, a height (H or h) of ridges of the corrugations decreases from an inner side to an outer side; and when the corrugations are formed in the lateral direction, a width (W) of the corrugations increases from an upper side to a lower side, and wherein a thickness of furrows of the corrugations is smaller than that of ridges of the corrugations.

2. The cosmetic container of claim 1, wherein the direction adjusting portion is made of an elastic material so that the handle portion is adjustable up, down, right, and left.

3. The cosmetic container of claim 2, wherein a blocking member is provided on an inside of the direction adjusting portion made of the elastic material.

4. The cosmetic container of claim 1, wherein the handle portion includes a plurality of handle portion members provided to be coupled to each other so that a length of the handle portion is extendable.

5. The cosmetic container of claim 1, wherein the touch member is a sponge or a puff.

6. The cosmetic container of claim 1, wherein:

a connection portion having a corresponding shape is coupled to an upper end of the body part; and the connection portion is detachably coupled to the handling portion.

7. The cosmetic container of claim 1, wherein a plate configured to store a cosmetic product is additionally provided in a lower end of the body part.

8. The cosmetic container of claim 7, wherein the plate is partitioned such that heterogeneous cosmetic products can be stored therein.

9. The cosmetic container of claim 8, wherein the heterogeneous cosmetic products are one or more of a solid cosmetic product, a powder cosmetic product, and a liquid cosmetic product.

10. The cosmetic container of claim 1, wherein a cover portion configured to cover the direction adjusting portion is coupled to the handle portion of the handling portion.

11. The cosmetic container of claim 1, wherein protrusions are further provided on one side of an inner surface of the body part.

12. The cosmetic container of claim 1, wherein an air check valve is provided in one side of the body part.

* * * * *